US010638228B1

(12) United States Patent
Coombs

(10) Patent No.: US 10,638,228 B1
(45) Date of Patent: Apr. 28, 2020

(54) LOW VOLTAGE IN-GROUND TRUNK LINE SYSTEM

(71) Applicant: Jeffery James Coombs, Lake Havasu City, AZ (US)

(72) Inventor: Jeffery James Coombs, Lake Havasu City, AZ (US)

( * ) Notice: Subject to any disclaimer, the term of this patent is extended or adjusted under 35 U.S.C. 154(b) by 0 days.

(21) Appl. No.: 15/393,592

(22) Filed: Dec. 29, 2016

Related U.S. Application Data

(63) Continuation-in-part of application No. 15/199,874, filed on Jun. 30, 2016, which is a continuation-in-part of application No. 12/806,596, filed on Aug. 17, 2010, now abandoned, application No. 15/393,592, which is a continuation-in-part of application No. 13/625,297, filed on Sep. 24, 2012.

(60) Provisional application No. 62/272,387, filed on Dec. 29, 2015, provisional application No. 61/274,618, filed on Aug. 18, 2009, provisional application No. 61/343,088, filed on Apr. 22, 2010, provisional application No. 61/541,070, filed on Sep. 29, 2011.

(51) Int. Cl.

| | |
|---|---|
| ***H04R 3/12*** | (2006.01) |
| ***H04R 5/02*** | (2006.01) |
| ***H04R 5/04*** | (2006.01) |
| ***H04R 1/34*** | (2006.01) |
| ***H04R 1/06*** | (2006.01) |

(52) U.S. Cl.
CPC ..... *H04R 3/12* (2013.01); *H04R 1/06* (2013.01); *H04R 1/345* (2013.01); *H04R 5/02* (2013.01); *H04R 5/04* (2013.01); *H04R 2201/028* (2013.01)

(58) Field of Classification Search
CPC ..... H04R 3/007; H04R 3/00; H04R 2420/07; H04R 2499/11; H04R 29/001; H04R 1/1041; H04R 1/227; H04R 25/554; H04R 19/005; H04R 1/021; H04R 1/028; H04R 1/20; H04R 1/22; H04R 1/2803; H04R 1/2834; H04R 1/2842; H04R 1/34
USPC ..... 381/120, 315, 337, 55, 1, 107, 108, 111, 381/17, 190, 331, 333, 395, 396, 400, 381/401, 56, 77
See application file for complete search history.

(56) References Cited

U.S. PATENT DOCUMENTS

| | | | | | |
|---|---|---|---|---|---|
| 4,061,891 | A * | 12/1977 | Pommer | G01R 21/005 | 381/58 |
| 4,321,554 | A * | 3/1982 | Quilter | H03F 1/52 | 330/297 |
| 5,164,991 | A * | 11/1992 | Johnson | H03F 1/56 | 330/297 |
| 6,687,380 | B1 * | 2/2004 | Vishwamitra | H04R 1/025 | 181/150 |
| 2003/0220705 | A1 * | 11/2003 | Ibey | H04R 5/04 | 700/94 |
| 2005/0031151 | A1 * | 2/2005 | Melillo | H04R 9/046 | 381/401 |
| 2006/0072776 | A1 * | 4/2006 | Vishwamitra | H04R 1/025 | 381/388 |

(Continued)

*Primary Examiner* — Akelaw Teshale
(74) *Attorney, Agent, or Firm* — Paul B. Heynssens Attorney at Law, PLC

(57) ABSTRACT

The system allows for distribution of 70 Volt high-voltage audio underground in direct burial cable or conduit. From the converter box the audio wires will be coming out of the earth at a safe 8 ohms (minimized shock risk). Typically the size (power output) of the amplifier alone limits how many 70 V converter boxes can have daisy chained together.

4 Claims, 10 Drawing Sheets

(56) References Cited

U.S. PATENT DOCUMENTS

| | | | | |
|---|---|---|---|---|
| 2007/0263883 | A1* | 11/2007 | Jakowski | H04R 3/00 381/110 |
| 2008/0240468 | A1* | 10/2008 | Adam | H01R 4/2408 381/120 |
| 2011/0170716 | A1* | 7/2011 | Stevens | H03F 1/0211 381/120 |
| 2011/0228967 | A1* | 9/2011 | Kulchy | F16M 11/08 381/394 |
| 2011/0317861 | A1* | 12/2011 | Haase | F21V 33/0056 381/333 |

* cited by examiner

Inground Converter
Multi System Wiring
Schematic
up to 64 Satellites
and 8 Subwoofers In-Ground Trunkline Module
70 Volt to 8 ohm Converter

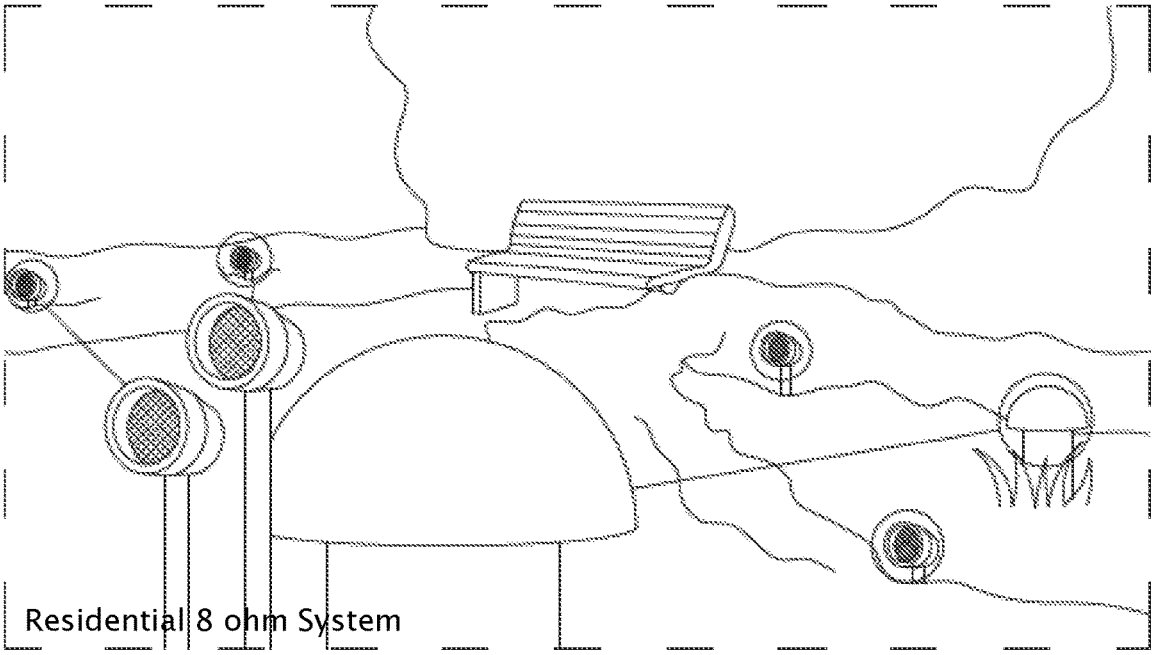

The *SonArray* Landscape Audio System has been designed from the ground up to provide installers with a simple, high quality, professional outdoor audio solution that delivers amazing sound and perfectly-even volume levels for areas up to 2000 square feet (186 square meters).

Fully immerses outdoor spaces in perfectly balanced sound by strategically placing eight satellite speakers and a buried subwoofer around the perimeter while being hidden amongst the landscape.

*SonAr ray* Landscape Audio System:
(8) Full Range Satellite speakers
(1) High Impact Subwoofer
(8) Mounting stakes
(1) Installation manual

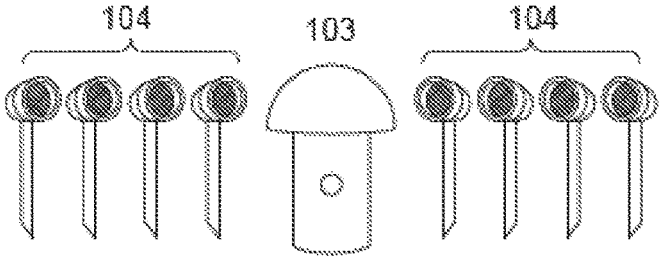

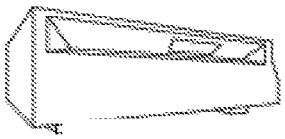

Any receiver or amplifier up to 1 00 watts at 8ohms can be used for our *SonArray* Landscape Audio System. *(Requires* all Satellite *speakers)*

*Shown: Sherwood RX-4508 Receiver- With Bluetooth*

Exemplary 8 Ohm System
Driving Amplifier
100

FIG. 7

Left/Right - Stereo Configuration
8 ohm Wiring for single system installation

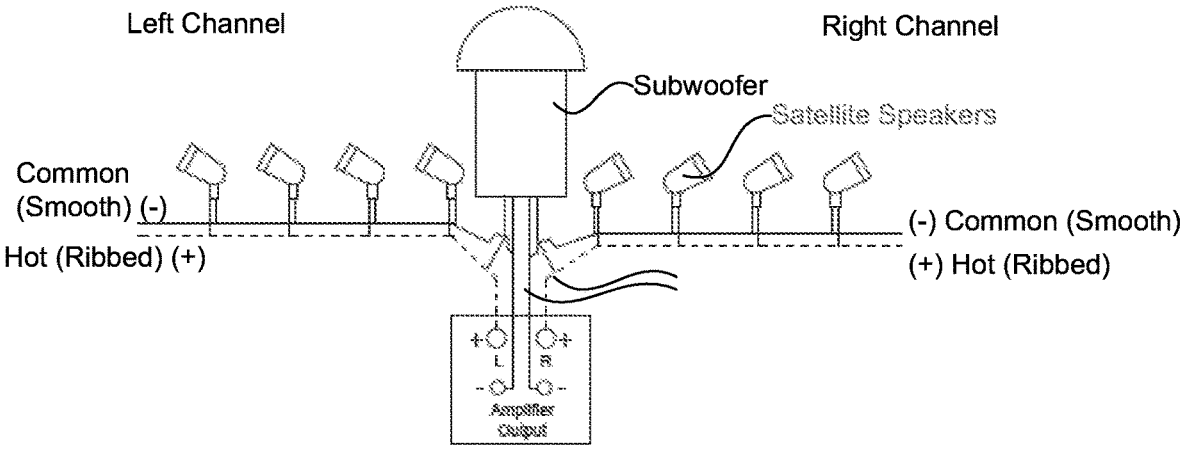

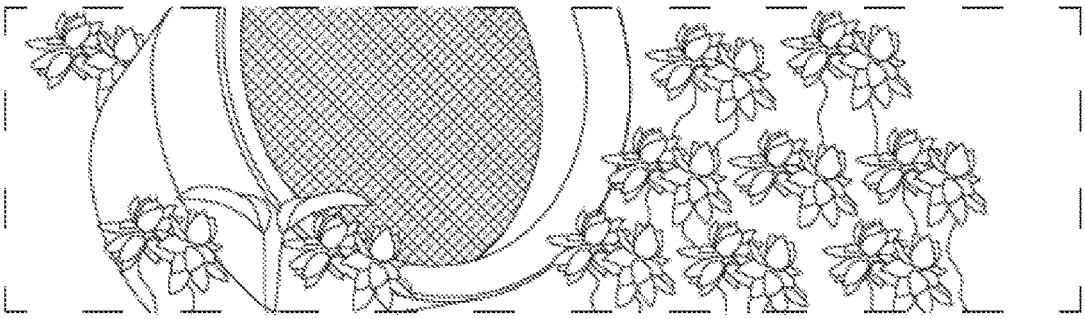

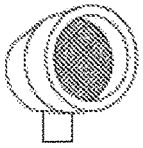

Full Range Satellight Speaker
- *3.5"* full range, anodized aluminum cone
- Frequency Response: 100Hz- 20KHz
- Self resetting polyswitch
- SPL 85 db
- Glass reinforced ABS enclosure

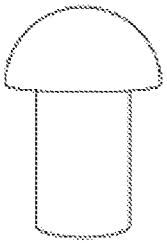

High Impact Subwoofer
- 8" Dual voice coil, poly cone
- Direct Fire
- Frequency Response: 40-100Hz
- Self resetting polyswitch
- SPL 89dB
- High density composite enclosure
- Powder coated aluminum canopy

FIG. 8

Landscape Audio System

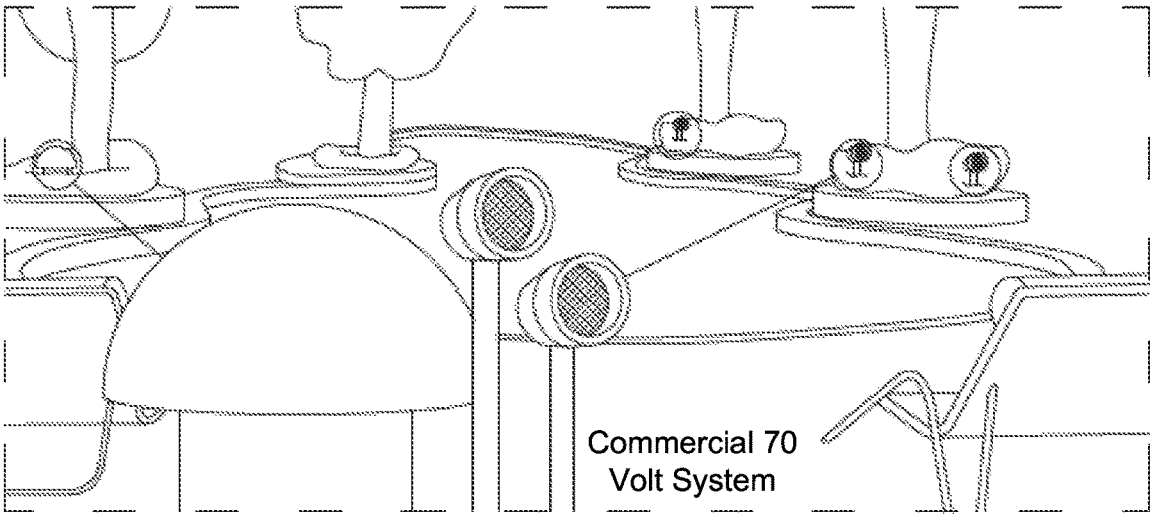

The SonArray Landscape Audio System has been designed from the ground up to provide installers with a simple, high quality, professional outdoor audio solution that delivers amazing sound and perfectly-even volume levels for large commercial installations by using our 70 Volt Muilt-System In-Ground Converters. (Up to 64 Satellites and 8 Subwoofers)

Fully immerses outdoor spaces in perfectly balanced sound by strategically placing satellite speakers and buried subwoofers around the perimeter while being hidden amongst the landscape.

*SonArray* Landscape Audio System:
(8) Full Range Satellight speakers
(1) High Impact Subwoofer
(8) Mounting stakes
(1) Installation manual

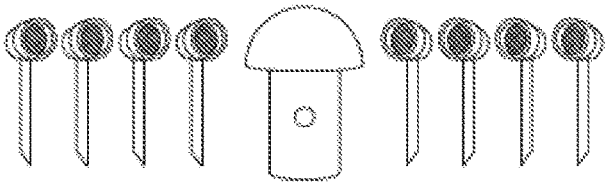

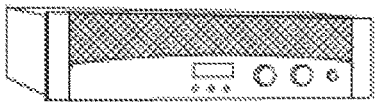

Up to eight (8) *SonArray* Landscape Audio Systems can be connected together using our 70 Volt Multi-System In-Ground Converters and appropriate 70V amplifier. *(64 Satellites and 8 Subwoofers)*

Shown: CROWN CDi1000 - Digital Signal Processing 70 to 100 V Output, 100 W/CH
100

FIG. 9

70 Volt Wiring Schematic
Left/Right- Stereo Configuration
70 Volt Wiring Using In-Ground
Converters for Multiple Systems
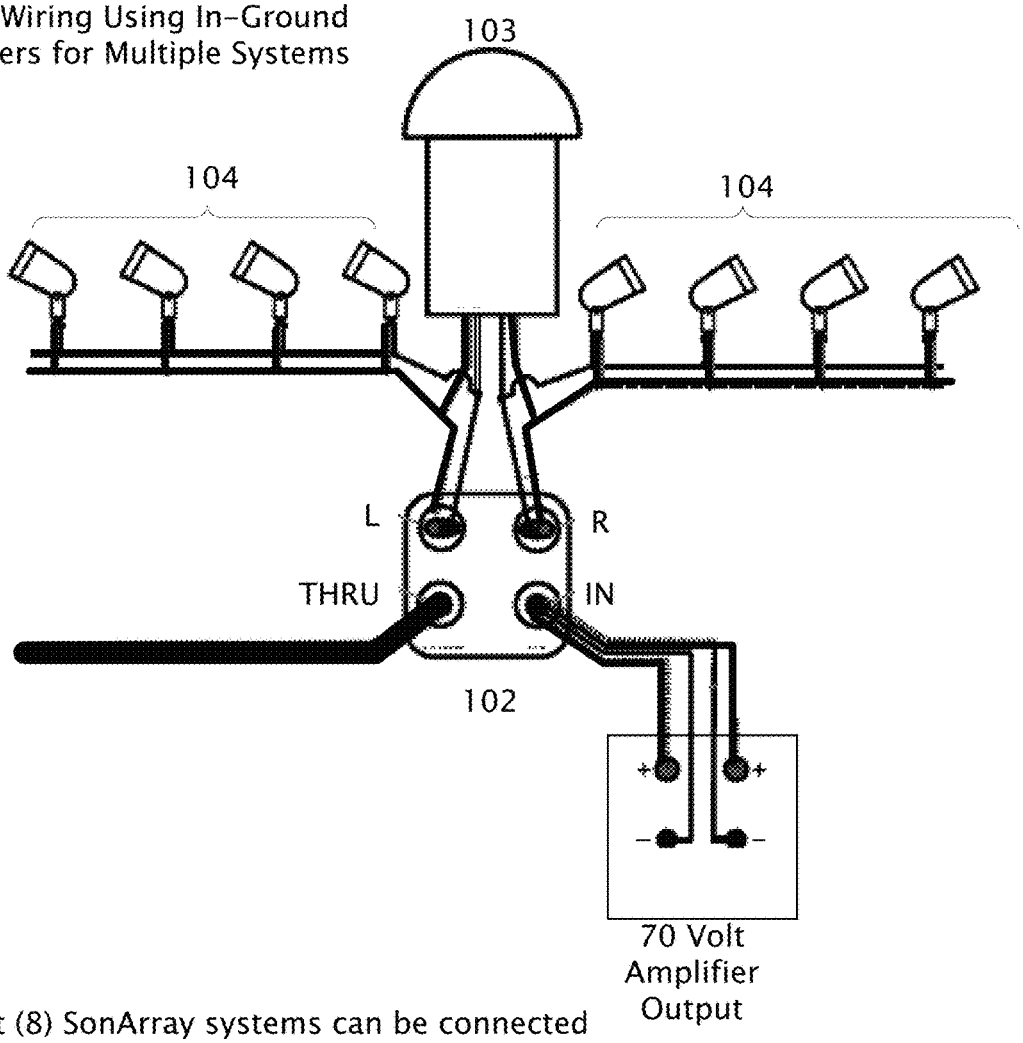
Up to Eight (8) SonArray systems can be connected
together using our in-ground converters
(Maximum of 64 Satellites and 8 Subwoofers)
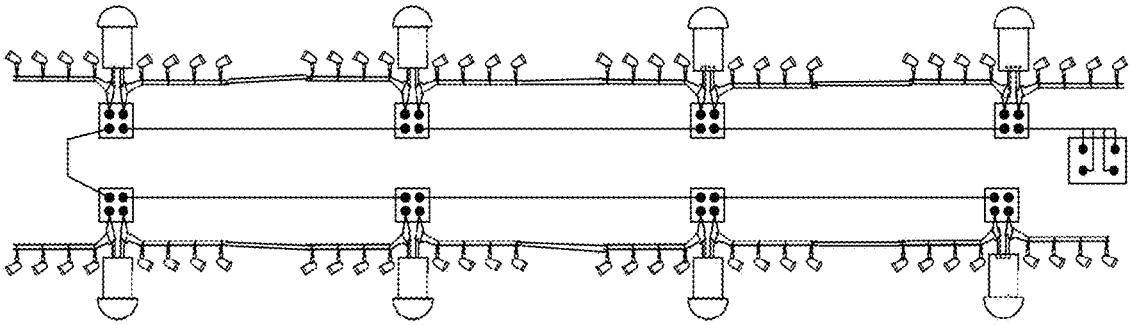
FIG. 10

LOW VOLTAGE IN-GROUND TRUNK LINE SYSTEM

CROSS-REFERENCE TO RELATED APPLICATIONS

This application claims the benefit of U.S. Provisional Patent Application No. 62/272,387, filed Dec. 29, 2015, the contents of which are hereby incorporated by reference. This application is also a continuation-in-part of application Ser. No. 15/199,874, filed Jun. 30, 2016 which is a continuation-in-part of application Ser. No. 12/806,596, filed Aug. 17, 2010 which also claims the benefit of U.S. Provisional Patent Application No. 61/274,618, filed Aug. 18, 2009, and U.S. Provisional Patent Application Ser. 61/343,088, filed Apr. 22, 2010, the contents of which are hereby incorporated by reference. This application is also a continuation-in-part of application Ser. No. 13/625,297, filed Sep. 24, 2012 which also claims the benefit of U.S. Provisional Patent Application No. 61/541,070, filed Sep. 29, 2011, the contents of which are hereby incorporated by reference.

TECHNICAL FIELD

This description relates generally to outdoor audio systems and more specifically to outdoor audio systems utilizing in-ground instillation.

BACKGROUND

Audio distribution systems, especially those commonly used in outdoor speakers, etc., may require that many loudspeakers be driven from a single audio amplifier over long runs of speaker wire. It may be possible to connect 20 or 30 speakers in series/parallel combinations to achieve an acceptable impedance load of the speakers to the amplifier. However, this type system can be difficult to install and troubleshoot, and can be unreliable and inflexible to later modification. A "constant-voltage" or "high-impedance" audio distribution system is often used to overcome these and a number of other possible problems. These systems may be referred to by their nominal voltage, with "70-Volt" and "25-Volt" systems being the most common references.

In a typical 70 volt systems an impedance and voltage transformation is performed that allows the single amplifier to drive many speakers. Amplifiers that are designed for these systems may differ from "standard" audio power amplifiers in that they employ a large transformer at the output of the amplifier.

Attached to each speaker in a 70V system is typically another transformer that changes the power back to lower voltage/higher current from the input of a higher voltage (70) and lower current, suitable to drive the 8-ohm speaker attached to it-a so called 70 volt to 8 ohm conversion as used in the industry. Such transformers may usually have two output taps, one for 8-ohm speakers, and one for 4-ohm speakers.

However, in spite of the usefulness of 70 Volt systems in speaker systems, 70 volt systems they are considered high voltage according to typical building codes which is a disadvantage in installing such systems since extra care and expertise may be required. It would be desirable to find a way to configure an outdoor audio system such that users, and installers are isolated from the 70 Volt portion of the audio system, and only exposed to safer lower voltages.

SUMMARY

The following presents a simplified summary of the disclosure in order to provide a basic understanding to the reader. This summary is not an extensive overview of the disclosure and it does not identify key/critical elements of the invention or delineate the scope of the invention. Its sole purpose is to present some concepts disclosed herein in a simplified form as a prelude to the more detailed description that is presented later.

The present example provides for distribution of 70 Volt high-voltage audio underground in direct burial cable or conduit. From the converter box the audio wires will be coming out of the earth at a safe 8 ohms (no shock risk). Typically the size (power output) of the amplifier alone limits how many 70 V converter boxes can have daisy chained together Many of the attendant features will be more readily appreciated as the same becomes better understood by reference to the following detailed description considered in connection with the accompanying drawings.

DESCRIPTION OF THE DRAWINGS

The present description will be better understood from the following detailed description read in light of the accompanying drawings, wherein:

FIG. 7-10 show exemplary residential and commercial audio systems using the low voltage in-ground trunk line system described herein Like reference numerals are used to designate like parts in the accompanying drawings.

DETAILED DESCRIPTION

The detailed description provided below in connection with the appended drawings is intended as a description of the present examples and is not intended to represent the only forms in which the present example may be constructed or utilized. The description sets forth the functions of the example and the sequence of steps for constructing and operating the example. However, the same or equivalent functions and sequences may be accomplished by different examples.

The examples below describe a 70 volt system. Although the present examples are described and illustrated herein as being implemented in a 70 volt system, the system described is provided as an example and not a limitation. As those skilled in the art will appreciate, the present examples are suitable for application in a variety of voltage type systems.

Figure 1:
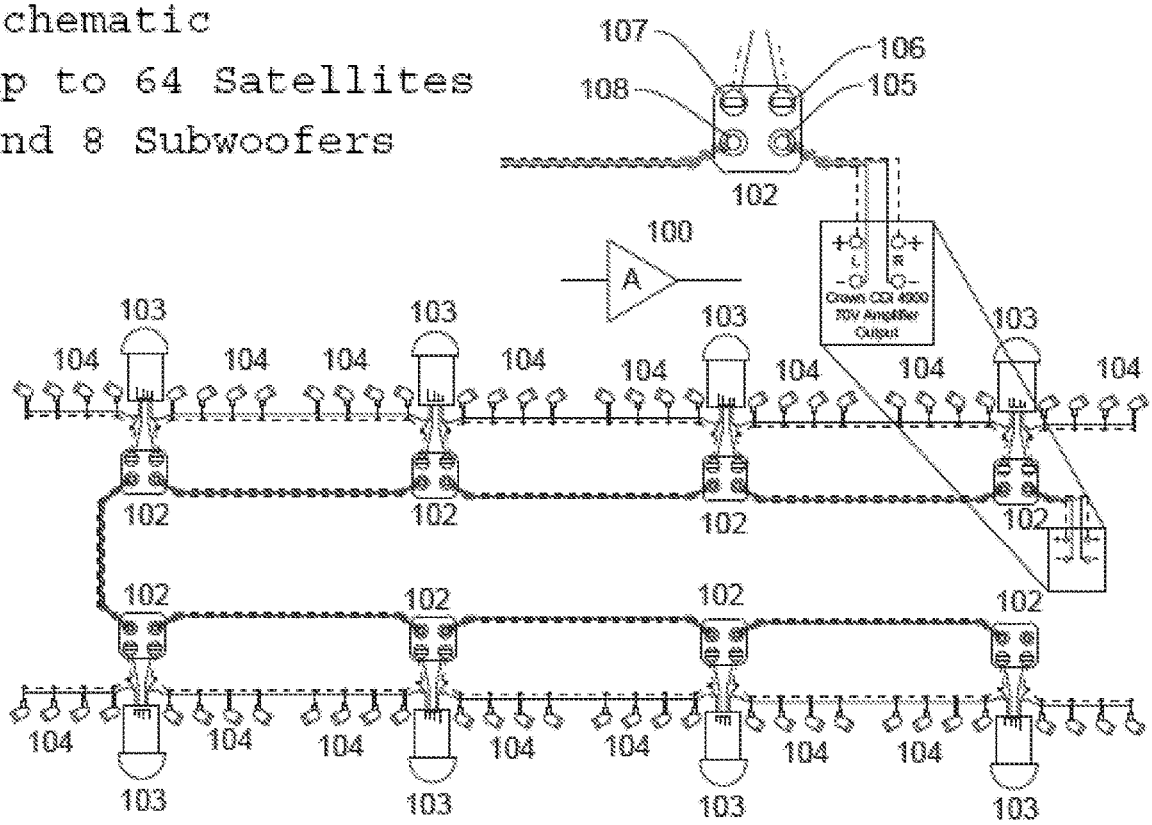
FIG. 1 is a diagram showing an exemplary in-ground converter multi system wiring schematic.

FIG. 1 is a diagram showing an exemplary in ground converter multi system wiring schematic. Such a system may be equivalently characterized as a trunk line system for power distribution. The system allows for distribution of 70 Volt high-voltage audio underground in direct burial cable or conduit. In equivalent examples other voltages such as 25 Volt, 100 Volt or equivalent systems may be utilized. It should be noted that the examples described are suitable for use in residential or commercial applications. From the converter box the audio wires will be coming out of the earth at a safe 8 ohms (no shock risk). Typically the size (power output) of the amplifier alone limits how many 70 V converter boxes can have daisy chained together.

A power amplifier for outdoor use in typical 70 V systems 100 having outputs 105, 108 is coupled to a plurality of 70 Volt to 8 Ohm converter boxes 102, in a daisy chain configuration. Each box 102 has an "in" 105 connection from the side of the box closest to the amp, and a "thru" or output connection 108 going to the next box in the daisy chain. The low voltage 8 Ohm outputs from the box 102 include a right 108 and left 106 channel connection coupled to a plurality of speakers typically including at least one subwoofer 103, and at least one or more speakers 104 covering a desired audible frequency range not covered by the subwoofer 104.

Figure 2:
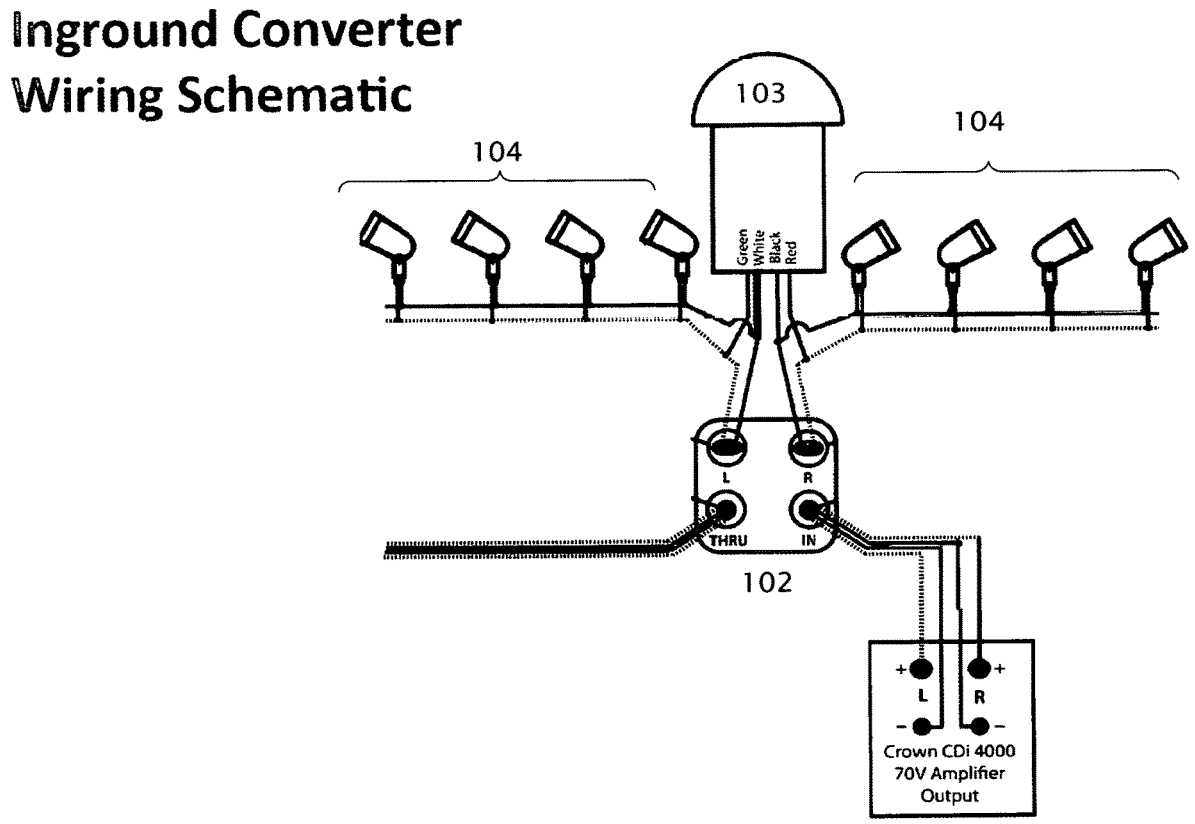
FIG. 2 shows further detail of the in-ground converter wiring schematic.

FIG. 2 shows further detail of the in-ground converter wiring schematic.

Figure 3:
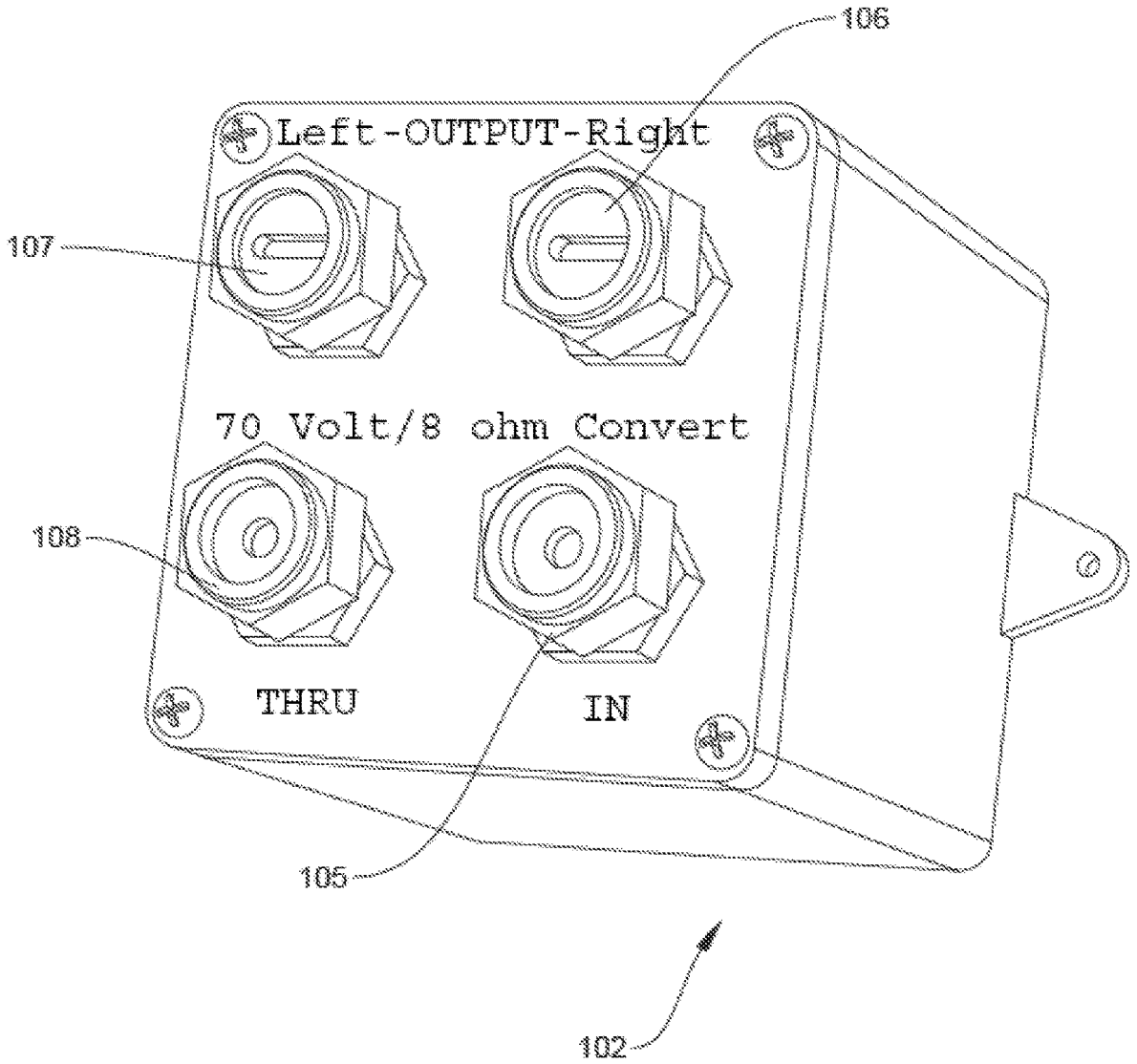
FIG. 3 shows an exemplary in-ground trunk line module 70 volt to 8 ohm converter in an inclined pictorial view
Figure 4:
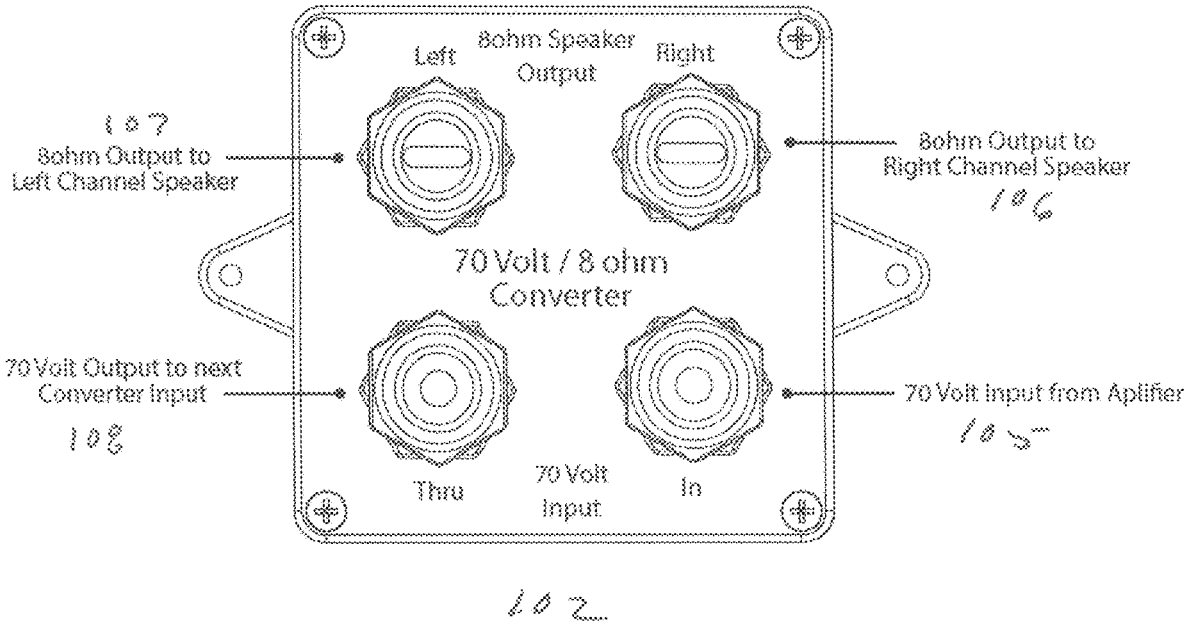
FIG. 4 shows an exemplary in-ground trunk line module 70 volt to 8 ohm converter in an top view.

FIG. 3 shows an exemplary in-ground trunk line module 70 volt to 8 ohm converter in an inclined pictorial view FIG. 4 shows an exemplary in-ground trunk line module 70 volt to 8 ohm converter in a top view.

Figure 5:
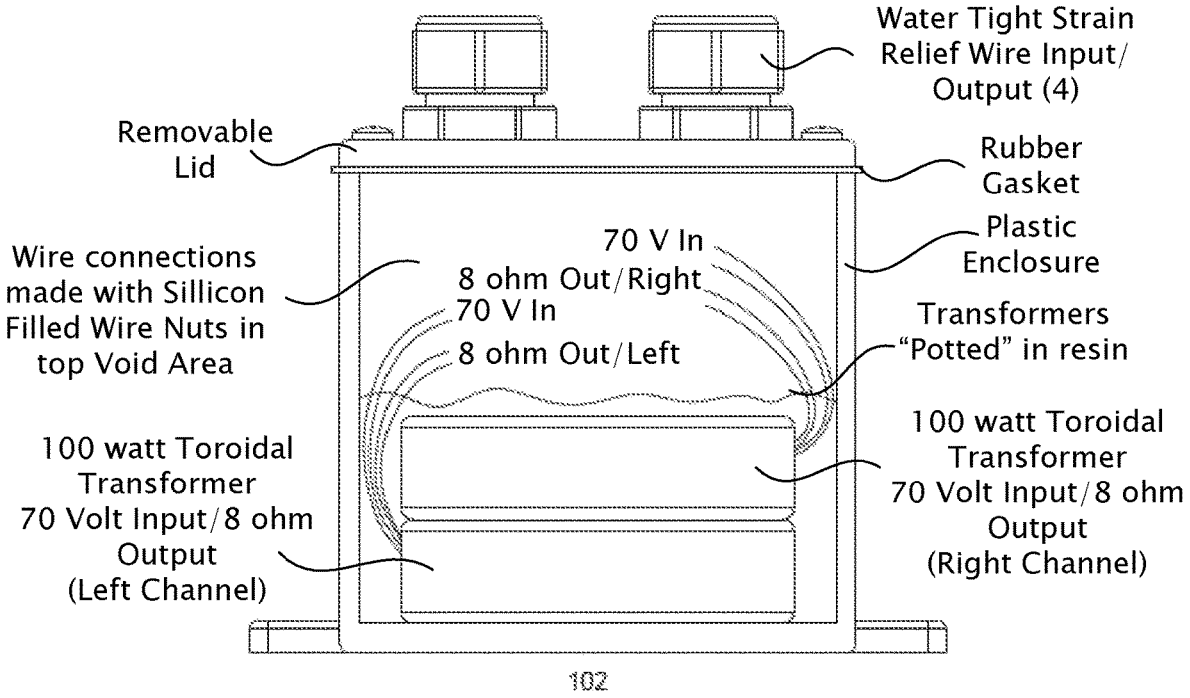
FIG. 5 shows an exemplary in-ground trunk line module 70 volt to 8 ohm converter in an side cut away view

FIG. 5 shows an exemplary in-ground trunk line module 70 volt to 8 ohm converter in an side cut away view. It should be noted that to achieve the overall safety provided by the system that the 70V part of the system may be buried under ground using watertight conduit and fittings. Also the box 102 is typically below grade calling for care in making the box impervious to moisture. As shown in then figure gaskets or seals may be used to attach a cover or access port. Water proof conduit connections, silicone filled wire nuts and the like may be used to shield the circuitry from moisture. Transformers (toroidal or equivalent) are typically potted in resin or an equivalent as well. In equivalent examples solid state voltage conversion circuitry may be utilized.

Figure 6:
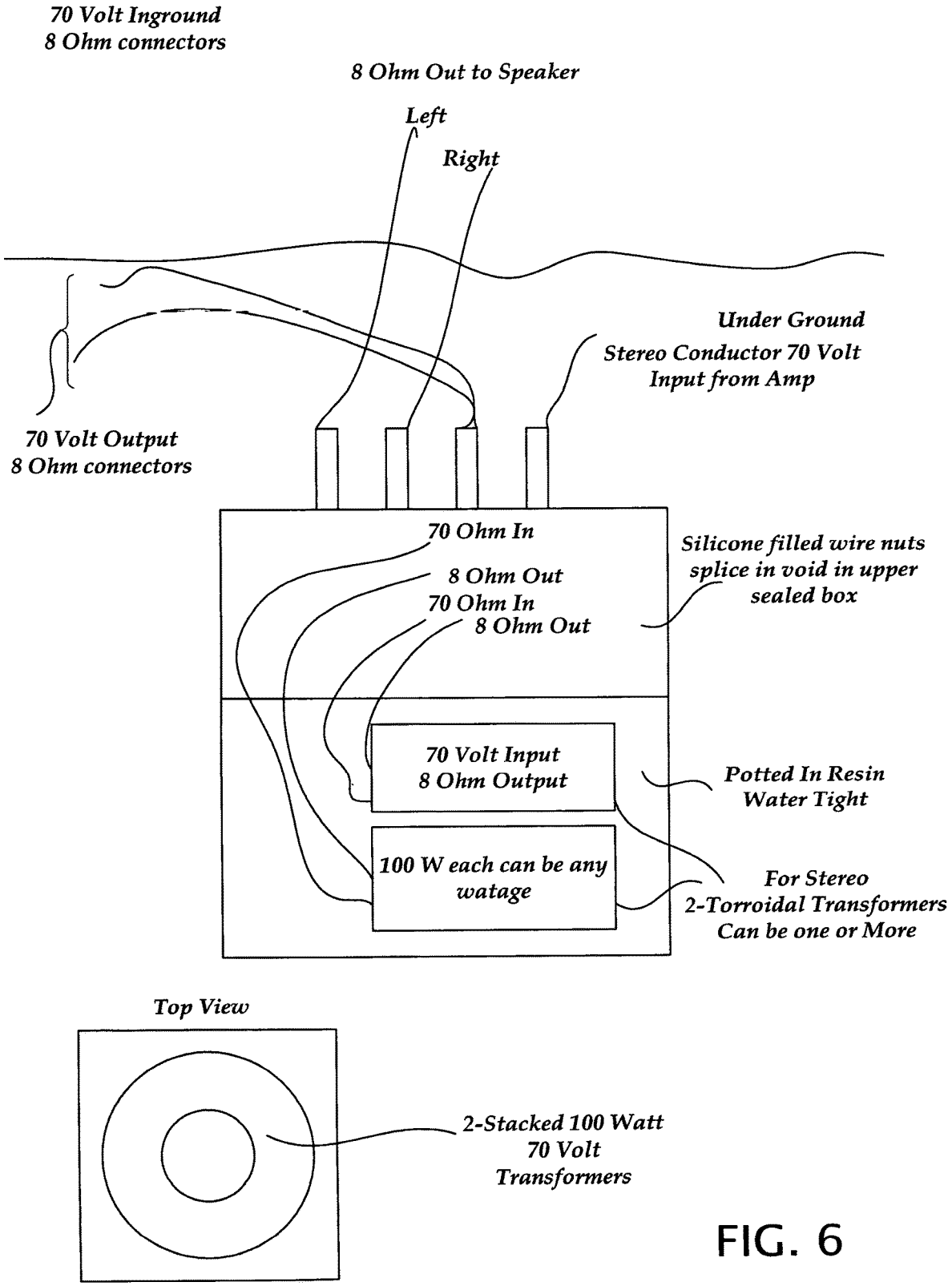
FIG. 6 is a diagram showing an in-ground 70 V to 8 ohm converter with additional design notations.

FIG. 6 is a diagram showing an in-ground 70 V to 8 ohm converter with additional design notations.

FIG. 7-10 show an exemplary residential and commercial audio systems using the low voltage in-ground trunk line system described herein Those skilled in the art will realize that the process sequences described above may be equivalently performed in any order to achieve a desired result. Also, sub-processes may typically be omitted as desired without taking away from the overall functionality of the processes described above.

The invention claimed is:

1. A residential in ground outdoor audio system comprising:

an amplifier having a nominal 70 volt amplifier signal output;

a plurality of speakers;

at least one 70 volt to 8 Ohm in-ground trunkline converter modules including at least one toroidal transformer potted in resin, having a toroidal transformer input coupled to the nominal 70 volt amplifier signal output, and a toroidal transformer output coupled to at least one of the plurality of speakers and in which the at least one in-ground converter module is weatherproof and including an access port having a gasket and waterproof conduit connections;

whereby a successive in-ground trunkline converter module of the at least one 70 volt to 8 Ohm in-ground trunkline converter modules is connected in daisy chain configuration to a previous in-ground trunkline converter module of the at least one 70 volt to 8 Ohm in-ground trunkline converter modules; and whereby, the nominal 70 volt amplifier signal output is converted to a signal suitable for driving an 8 Ohm input to the at least one speaker of the plurality of speakers.

2. A residential in ground outdoor audio system comprising:

an amplifier having a nominal 70 volt amplifier signal output;

a plurality of speakers: and at least one 70 volt to 8 Ohm in-ground trunkline converter module with an access port including a gasket and weatherproof conduit connectors solid state voltage conversion circuitry potted in resin having an input coupled to the nominal 70 volt amplifier signal output, and an output coupled to at least one of the plurality of speakers;

whereby, the nominal 70 volt amplifier signal output is converted to a signal suitable for driving an 8 Ohm input to the at least one speaker of the plurality of speakers by the solid state voltage conversion circuitry.

3. A residential in ground outdoor audio system comprising:

an amplifier having a nominal 70 volt amplifier signal output;

a plurality of speakers: and at least one 70 volt to 8 Ohm in-ground trunkline converter modules including a housing having an enclosure, a cover, a gasket, and weatherproof conduit connections to seal the cover against the housing, and within the housing at least one toroidal transformer potted in resin having a toroidal transformer input coupled to the nominal 70 volt amplifier signal output, and a toroidal transformer output coupled to at least one of the plurality of speakers;

whereby, the nominal 70 volt amplifier signal output is converted to a signal suitable for driving an 8 Ohm input to the at least one speaker of the plurality of speakers.

4. The residential in ground outdoor audio system of claim 3 in which the cover includes at least one waterproof conduit connection.

* * * * *